US005234063A

United States Patent [19]

Collinsworth

[11] Patent Number: 5,234,063

[45] Date of Patent: Aug. 10, 1993

[54] REMOVABLE WEAR PROTECTIVE MEANS FOR A DRILLING TOOL

[76] Inventor: Stephen M. Collinsworth, P.O. Box 358, Stanton, Ky. 40380

[21] Appl. No.: 890,558

[22] Filed: May 28, 1992

Related U.S. Application Data

[63] Continuation-in-part of Ser. No. 713267, Jun. 11, 1991, abandoned.

[51] Int. Cl.[5] ..... E21B 17/10

[52] U.S. Cl. ..... 175/325.2; 175/325.5; 175/408

[58] Field of Search ..... 175/325.2, 325.4, 325.5, 175/408, 406

[56] References Cited

U.S. PATENT DOCUMENTS

| | | | |
|---|---|---|---|
| 2,022,101 | 11/1935 | Wright | 175/408 X |
| 2,562,346 | 7/1951 | Whittaker | 175/406 |
| 3,825,081 | 7/1974 | McMahon | 175/325.2 X |
| 3,833,077 | 9/1974 | Lavallee | 175/325.2 |
| 3,978,933 | 9/1976 | Olson et al. | 175/325.2 |
| 4,011,918 | 3/1977 | Jurgens | 175/325.2 |
| 4,258,804 | 3/1981 | Richey et al. | 175/325.5 |
| 4,549,613 | 10/1985 | Case | 175/325.2 |

*Primary Examiner*—Stephen J. Novosad
*Attorney, Agent, or Firm*—Frank C. Leach, Jr.

[57] ABSTRACT

A drill bit sub, which has a drill bit with three equally angularly spaced cutters releasably threaded into its bottom surface, has its lower portion reduced in diameter. A collar is welded to the uppermost portion of the lower portion of the drill bit sub and has its lower surface formed at an angle to its longitudinal axis. A protective sleeve, which is a hollow cylindrical metal tube, is removably mounted on the lower portion of the drill bit sub and has its upper surface at the same angle as the lower surface of the collar. The protective sleeve has three equally angularly spaced wear strips, which are substantially aligned with the three cutters on the drill bit. A first break out ring is mounted between the bottom of the protective sleeve and a support surface on the drill bit so that the drill bit bears against the bottom of the first break out ring. The drill bit sub has its upper portion, which is beneath its threaded upper end threaded into a threaded receptacle in a lowermost drill section of the drilling tool, reduced to receive a second break out ring.

29 Claims, 3 Drawing Sheets

REMOVABLE WEAR PROTECTIVE MEANS FOR A DRILLING TOOL

This application is a continuation-in-part of application Ser. No. 07/713,267, filed Jun. 11, 1991, now abandoned.

This invention relates to a wear protective means for a drilling tool and, more particularly, to removable wear protective means for a drilling tool.

This invention is an improvement of my U.S. Pat. No. 5,058,689. In my aforesaid patent, the drill bit sub has a lower reduced portion on which a protective sleeve and a wear strip support are mounted with the protective sleeve releasably attached to the drill bit sub in two of its three embodiments. The protective sleeve has driving means to transmit rotation of the drill bit sub to the wear strip support during rotation of the drill bit sub. In the third embodiment of my aforesaid patent, only a wear strip support is removably mounted on the lower reduced portion of the drill bit sub with the drill bit having slots to receive the wear strips on the wear strip support to provide rotation of the wear strip support with the drill bit sub.

The invention of my aforesaid patent functions satisfactorily in that it enables replacement of the protective sleeve and the wear strip support or just the wear strip support if only the wear strip support is used whenever the drill bit is replaced. Thus, the drill bit sub does not have to be replaced or have new wear strips mounted thereon each time that the drill bit is replaced.

The present invention requires only one removable hollow cylindrical metal tube, which supports the wear strips and functions as a protective sleeve, without any modification of the drill bit to provide driving thereto as is required in my aforesaid patent. The present invention accomplishes this through forming the upper surface of the protective sleeve at an angle to its longitudinal axis for cooperation with an annular surface on the drill bit sub having the same angle. These two surfaces are held against each other when the drill bit is secured to the bottom of the drill bit sub and bears against a break out ring mounted between the bottom of the protective sleeve and a support surface of the drill bit.

The protective sleeve of the present invention protects the drill bit sub from the sand blast effect generated by the force of pressurized air used to clean the hole being drilled as discussed in my aforesaid patent. When the protective sleeve of the present invention wears, it can be replaced when changing the drill bit.

It has been found that the protective sleeve of the present invention can increase the life of a drill bit sub by at least 400% in comparison with the life of a drill bit sub used prior to the invention of my aforesaid patent. With the average cost of a protective sleeve of the present invention being $112 and the average cost of a drill bit sub being $500, there is a significant financial saving with the present invention.

Additionally, an old drill bit sub, which has been junked by a user because of wear on its lower portion, can still be used with the present invention. It is only necessary to reduce the diameter of the lower portion to receive the protective sleeve of the present invention.

By using a break out ring, which has at least one weakened portion capable of being fractured and preferably two weakened portions diametrically disposed to each other, between the bottom of the protective sleeve and the drill bit, the drill bit can be removed manually after the break out ring is broken and removed. Without the break out ring, it has been found that at least 75% of the drill bits, which are continuously tightened into a drill bit sub during drilling, must be beaten off with a sledge hammer or heated with a torch, which destroys the temper of the metal, and then beaten off. When the drill bit is hit with such a large force, metal will fly off from the drill bit and can injure the person removing the drill bit. Therefore, the use of the break out ring between the bottom of the protective sleeve and the drill bit substantially decreases the possibility of injury to the user.

The present invention preferably has the upper portion of the drill bit sub reduced to receive an upper break out ring. This location of the upper break out ring is just beneath the upper threaded end of the drill bit sub, which threads into a threaded receptacle in the lowermost drill section of the drilling tool to which the drill bit sub is attached.

It has been found that the use of the upper break out ring enables manual removal of the drill bit sub from the lowermost drill section of the drilling tool. This permits the drill bit sub to be formed without break out lugs, which have previously been required to enable removal of the drill bit sub from the lowermost drill section by a wrench. Therefore, a further financial saving can be accomplished through forming a drill bit sub without break out lugs.

The protective sleeve of the present invention has the wear strips or stabilizer bars welded thereto. These wear strips are set in position on the protective sleeve so that each wear strip is directly above a cutter of the drill bit. It has been found that at least 97% of the cutters of the drill bits align with the wear strips and all of the cutters of the drill bits are in substantial alignment with the wear strips.

In addition to increasing the life of the drill bit sub by 400%, it also has been discovered that the life of the drill bit has been increased from 15% to 30% in comparison with the life of the drill bit even when used with the invention of my aforesaid patent. It is believed that this is because the protective sleeve and the two break out rings are not a solid part of the drill bit sub so that they function as a shock absorber during drilling to absorb some of the shock to which the drill bit is subjected.

An object of this invention is to provide removable wear protective means for a drilling tool.

Another object of this invention is to provide a break out ring for use with a drilling tool.

Other objects of this invention will be readily perceived from the following description, claims, and drawings.

This invention relates to a drilling tool for drilling a hole in the ground including a drill bit sub having a lower reduced portion with removably mounted means, which has a plurality of wear strips thereon, removably mounted thereon. The drill bit sub includes an annular surface formed at an angle to its longitudinal axis, and the removably mounted means has an upper annular surface formed at the same angle to its longitudinal axis as the annular surface of the drill bit sub for engagement with the annular surface of the drill bit sub when the removably mounted means is mounted on the lower reduced portion of the drill bit sub. A drill bit, which has a plurality of cutters, is releasably attached to the bottom of the drill bit sub for rotation therewith. The upper annular surface of the removably mounted means is held against the annular surface of the drill bit sub when the drill bit is releasably attached to the drill bit sub to prevent the removably mounted means from rotating relative to the drill bit sub when the drill bit sub is rotated. Each of the wear strips on the removably mounted means is substantially aligned with one of the cutters on the drill bit.

This invention also relates to a protective sleeve for removably mounting on a lower reduced portion of a drill bit sub of a drilling tool having a drill bit with cutters for drilling a hole in the ground with the drill bit releasably attached to the drill bit sub. The protective sleeve includes a hollow cylindrical tube having its upper surface formed at an angle to its longitudinal axis for engagement with a corresponding annular surface on the drill bit sub formed at the same angle to its longitudinal axis as the upper surface of the hollow cylindrical tube. The hollow cylindrical tube has a plurality of equally angularly spaced wear strips on its outer surface for substantial alignment with the cutters on the drill bit when the hollow cylindrical tube is mounted on the lower reduced portion of the drill bit sub and the drill bit is releasably attached to the drill bit sub to cause the upper surface of the hollow cylindrical tube to be held against the corresponding annular surface of the drill bit sub.

This invention further relates to a break out ring for mounting on a circular surface of a drilling tool. The break out ring includes inner and outer circular surfaces and first, second, and third weakened portions capable of being fractured. The second weakened portion is circumferentially spaced from the first weakened portion less than the second weakened portion is circumferentially spaced from the third weakened portion with the second weakened portion being circumferentially spaced less than 180° from the second weakened portion. The third weakened portion is circumferentially spaced from the first weakened portion less than the third weakened portion is circumferentially spaced from the second weakened portion.

The attached drawings illustrate preferred embodiments of the invention, in which.

Figure 1:
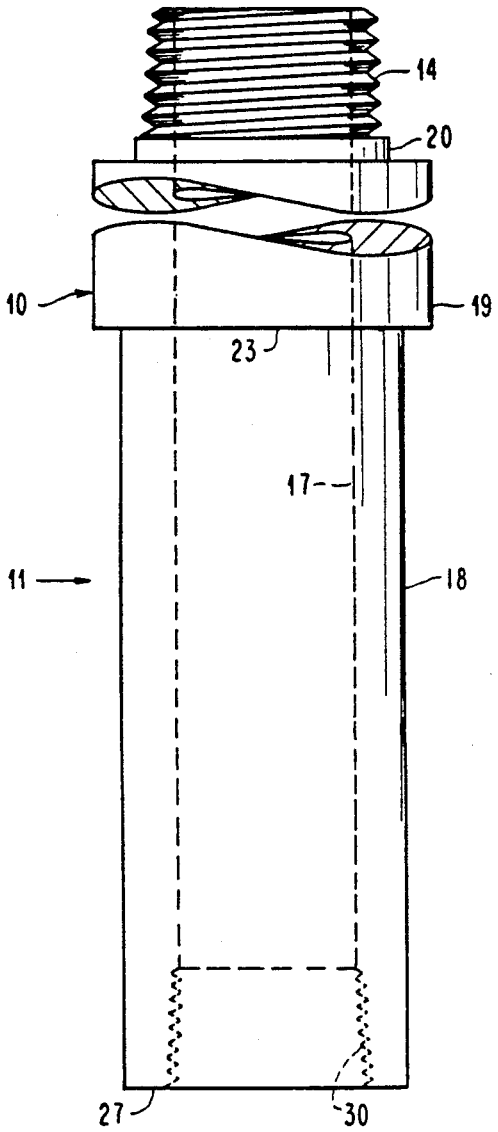
FIG. 1 is an elevational view of a drill bit sub of the present invention.

Referring to the drawings and particularly FIG. 1, there is shown a drill bit sub 10 of a drilling tool 11 for drilling a hole in the ground. The drill bit sub 10 is connected to a lowermost drill section 12 (see FIG. 2) of the drilling tool 11 through having its threaded upper end 14 (see FIG. 1) threaded into a threaded receptacle 15 (see FIG. 2) in the lowermost drill section 12 of the drilling tool 11.

The drilling tool 11 has driving means on the ground at the upper end of the drilling tool 11 for rotating the drill bit sub 10 in the well-known manner. Pressurized air is supplied from a pressurized air source (not shown) on the ground through communicating longitudinal or axial passages in the drill sections of the drilling tool 11 including a longitudinal or axial passage 16 in the lowermost drill section 12 to a longitudinal or axial passage 17 extending through the drill bit sub 10.

The drill bit sub 10 has a lower portion 18 (see FIG. 1) formed with a reduced diameter. The diameter of the lower portion 18 is ¾" smaller than the diameter of an intermediate portion 19 of the drill bit sub 10. For example, if the intermediate portion 19 has a diameter of 5½", the lower portion 18 has a diameter of 4¾".

The drill bit sub 10 has an upper portion 20 formed with a reduced diameter. The diameter of the upper portion 20 is 1" smaller than the diameter of the intermediate portion 19 of the drill bit sub 10. For example, if the intermediate portion 19 has a diameter of 5½", the upper portion 20 has a diameter of 4½".

A collar 21 (see FIG. 2), which extends for 4" and is a hollow cylindrical metal tube, is mounted on the lower portion 18 (see FIG. 1) of the drill bit sub 10 with its upper surface 22 (see FIG. 2) abutting a shoulder 23 (see FIG. 1) of the drill bit sub 10 at the junction of the lower portion 18 and the intermediate portion 19. The collar 21 (see FIG. 2), which has a substantially constant inner diameter, is welded to the drill bit sub 10 with the upper surface 22 of the collar 21 engaging the shoulder 23 (see FIG. 1) of the drill bit sub 10 and the weld formed therebetween.

The collar 21 (see FIG. 2) has its bottom surface 24, which is an annular surface, formed at an angle to the longitudinal axis of the collar 21 and the longitudinal axis of the drill bit sub 10 since the two longitudinal axes are aligned. The bottom surface 24 of the collar 21 is preferably at an angle of 85° to the longitudinal axis of the collar 21 or 5° to the horizontal. The angle of the bottom surface 24 of the collar 21 to its longitudinal axis can be in a range from 87° to almost the longitudinal axis of the collar 21.

A protective sleeve 25, which is a hollow cylindrical metal tube having a thickness of about ⅜" and a substantially constant diameter, is removably mounted on the lower portion 18 (see FIG. 1) of the drill bit sub 10. The protective sleeve 25 (see FIG. 2) has its upper surface 26, which is an annular surface, formed at the same angle to the longitudinal axis of the protective sleeve 25 as the angle of the bottom surface 24 of the collar 21 to the longitudinal axis of the collar 21.

The protective sleeve 25 extends for 0.1" beyond a bottom surface 27 (see FIG. 1) of the drill bit sub 10. With the overall length of the lower portion 18 of the drill bit sub 10 being 11.4" after cutting off the lowermost 0.6" of the drill bit sub 10, the protective sleeve 25 (see FIG. 2) extends for 7.5".

A drill bit 28, which has three equally angularly spaced cutters 29, is attached to the drill bit sub 10 through the drill bit sub 10 having a female threaded receptacle 30 (see FIG. 1), which extends from the bottom surface 27 of the drill bit sub 10 because of cutting off of the lowermost 0.6" of the drill bit sub 10, to receive a threaded protruding male end 31 (see FIG. 2) of the drill bit 28. When the collar 21 is welded to the drill bit sub 10, the uppermost point of the bottom surface 24 of the collar 21 must be vertically aligned with one of the cutters 29 on the drill bit 28.

A break out ring 32 preferably is disposed between a bottom surface 33 of the protective sleeve 25 and a support or seat surface 34 of the drill bit 28. The break out ring 32 has a diameter slightly larger than a protruding portion 35 of the drill bit 28 from which the threaded protruding male end 31 extends.

Figure 3:
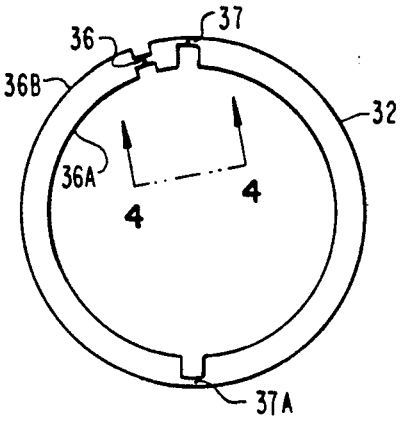
FIG. 3 is a top plan view of a bottom break out ring used with the drill bit sub of FIG. 1.

The break out ring 32 extends for 0.7". As shown in FIG. 3, the break out ring 32 has a first weakened portion 36 formed by removing 0.3" from both its inner surface 36A and its outer surface 36B for an arcuate distance of 0.5". The break out ring 32 has a second weakened portion 37 and a third weakened portion 37A, which are diametrically disposed, formed therein by forming a slot 0.6" from the inner surface 36A for an arcuate distance of 0.5". Since the break out ring 32 has a thickness of 0.7" between the inner surface 36A and the outer surface 36B, each of the weakened portions 36, 37, and 37A has a thickness of 0.1".

Figure 4:
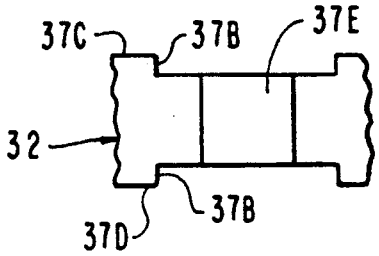
FIG. 4 is an enlarged fragmentary side elevational view of the bottom break out ring of FIG. 3 and taken along line 4—4 of FIG. 3.

As shown in FIG. 4. the break out ring 32 has a slot 37B formed in each of its upper surface 37C and its lower surface 37D. Each of the slots 37B extends for the arcuate distance of one inch from the center of the first weakened portion 36 (see FIG. 3) to the center of the second weakened portion 37. Each of the slots 37B (see FIG. 4) extends for a distance of 0.1" from the upper surface 37C or the lower surface 37D to leave a portion 37E with a thickness of 0.5".

The protective sleeve 25 (see FIG. 2) has a plurality of equally angularly spaced wear strips 38 mounted thereon. Each of the wear strips 38 preferably has a plurality of tungsten carbide inserts 39 in its outer surface.

The number of the wear strips 38 is equal to the number of the cutters 29 on the drill bit 28. With the drill bit 28 having three of the cutters 29, there are three of the wear strips 38 on the protective sleeve 25. Each of the wear strips 38 is aligned with the maximum outer protrusion of one of the cutters 29 on the drill bit 28.

It should be understood that vertically aligning the uppermost point of the bottom surface 24 of the collar 21 with one of the cutters 29 on the drill bit 28 when the collar 21 is welded to the drill sub 10 enables the wear strips 38 to be welded on each of the protective sleeves 25 in a jig. This is because one of the three equally angularly spaced wear strips 38 must be located on each of the protective sleeves 25 at a specific position, namely, in vertical alignment with the uppermost point of the upper surface 26 of the protective sleeve 25. This location of one of the wear strips 38 insures that the wear strip 38 is aligned with one of the cutters 29 on the drill bit 28 because the uppermost point of the bottom surface 24 of the collar 21 is vertically aligned with one of the cutters 29 on the drill bit 28 and the uppermost point of the upper surface 26 of the protective sleeve 25 mates with the uppermost point of the bottom surface 24 of the collar 21.

Each of the wear strips 38 could be 4" long, 1' wide, and 1" thick, for example. The thickness of each of the wear strips 38 depends on the difference in the diameters between the drill bit sub 10 and the drill bit 28.

Prior to attaching the drill bit sub 10 to the lowermost drill section 12 of the drilling tool 11, a break out ring 40, which has three weakened portions in the same manner as the break out ring 32, is disposed on the upper portion 20 (see FIG. 1) of the drill bit sub 10. The break out ring 40 (see FIG. 2) is 0.1" longer than the length of the upper portion 20 (see FIG. 1) of the drill bit sub 10. Since the upper portion 20 of the drill bit sub 10 has a length of 0.9", the break out ring 40 (see FIG. 2) has a length of 1".

When the drill bit 28 is attached to the drill bit sub 10 and bears against the bottom of the break out ring 32, the upper surface 26 of the protective sleeve 25 is held or pressed against the bottom surface 24 of the collar 21. Since the surfaces 24 and 26 can only mate in one position of the protective sleeve 25, this enables the protective sleeve 25 to be driven with the drill bit sub 10 and prevents rotation of the protective sleeve 25.

When the upper surface 26 of the protective sleeve 25 is at an angle of 85° or less to the longitudinal axis of the protective sleeve 25 and there is premature failure of the break out ring 32, the protective sleeve 25 is prevented from turning on the drill bit sub 10. This is because the length of the break out ring 32 is such that the protective sleeve 25 would fall but not sufficiently that the upper surface 26 of the protective sleeve 25 would cease to engage the bottom surface 24 of the collar 21.

If the break out ring 32 is not employed so that the length of the protective sleeve 25 is extended whereby the bottom surface 33 of the protective sleeve 25 engages the surface 34 of the drill bit 28, the angle of the bottom surface 24 of the collar 21 to the longitudinal axis of the collar 21 and the upper surface 26 of the protective sleeve 25 to the longitudinal axis of the protective sleeve 25 can be up to 87°. Of course, a change in the length of the break out ring 32 also could affect the maximum angle of the bottom surface 24 of the collar 21 and the upper surface 26 of the protective sleeve 25.

When it is desired to remove the drill bit sub 10 from the lowermost drill section 12 of the drilling tool 11, the three weakened portions of the break out ring 40 are fractured. This can be easily accomplished with a chisel, for example.

The fracturing of the weakened portions of the break out ring 40 will be described with respect to the break out ring 32 (see FIG. 3). First, the first weakened portion 36 of the ring 32 is fractured by a chisel, for example. Then, the chisel is placed beneath the lower surface 37D (see FIG. 4) to bend the portion 37E upwardly to enable the chisel to fracture the second weakened portion 37 (see FIG. 3). Finally, the third weakened portion 37A is fractured by the chisel.

When the break out ring 40 (see FIG. 2) is broken and removed, the drill bit sub 10 can be manually removed from the lowermost drill section 12 of the drilling tool 11. Thus, there is no requirement for break out lugs on the drill bit sub 10.

Figure 2:
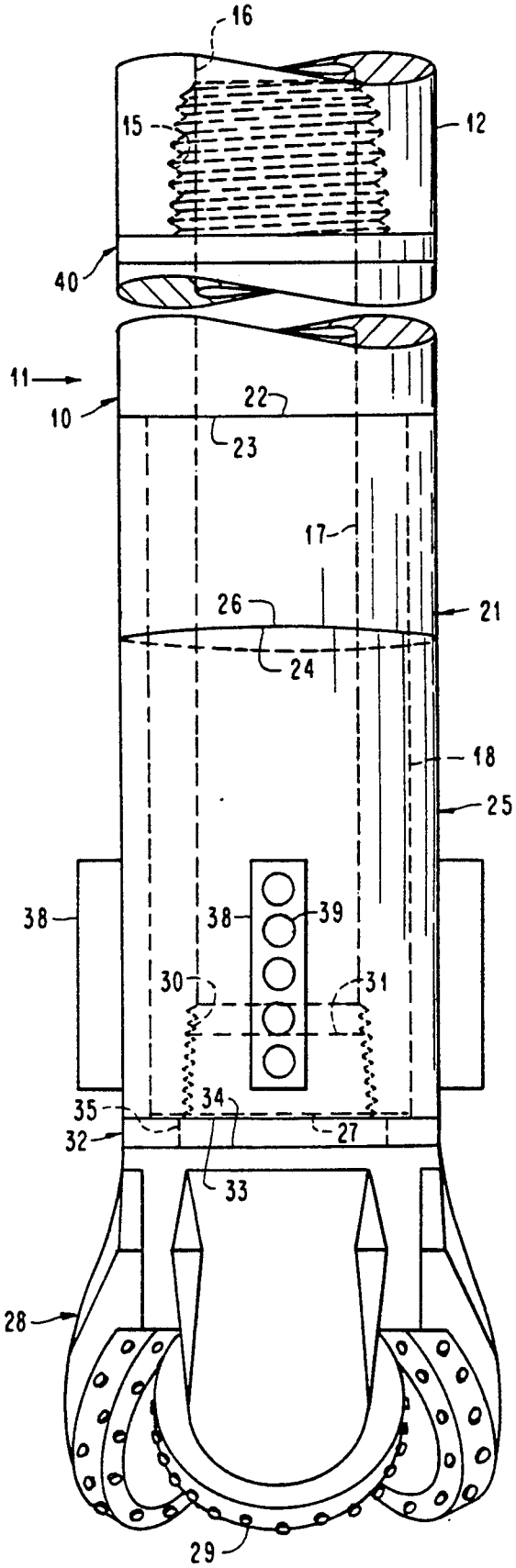
FIG. 2 is an elevational view of the drill bit sub of FIG. 1 attached to a lowermost drill section of a drilling tool with a pair of break out rings, a protective sleeve, and a drill bit mounted thereon.

When the drill bit 28 is to be removed from the drill bit sub 10, the weakened portions 36 (see FIG. 3), 37, and 37A of the break out ring 32 are fractured by a chisel, for example, in the same manner as previously described with respect to the break out ring 40 (see FIG. 2). Then, the drill bit 28 can be manually unthreaded from the drill bit sub 10.

Figure 5:
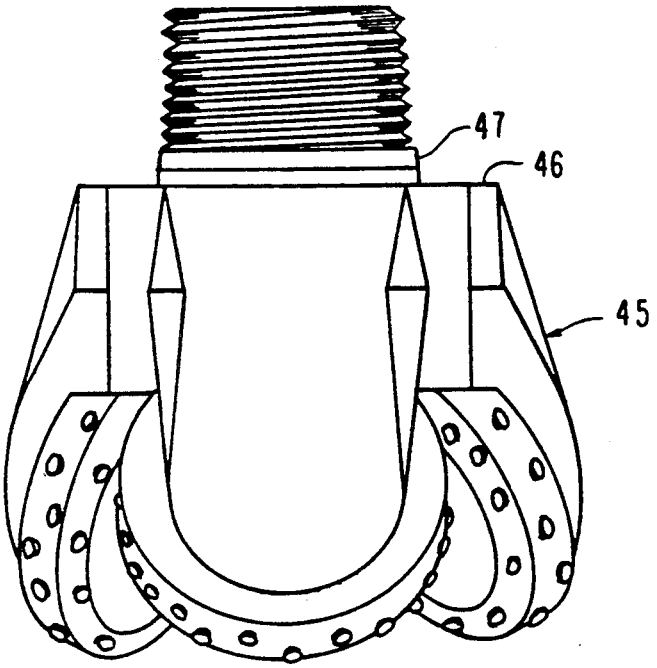
FIG. 5 is an elevational view of a modification of a drill bit to support the bottom break out ring of FIG. 2.

Referring to FIG. 5, there is shown a drill bit 45 having a support or wear surface 46 formed beneath its protruding portion 47 to support the bottom of the break out ring 32 (see FIG. 2). The surface 46 (see FIG. 5) is formed by removing a portion of the drill bit 45 beneath the protruding portion 47.

With the drill bit 45, the drill bit sub 10 (see FIG. 2) extends beyond the bottom surface 33 of the protective sleeve 25 for about 0.4". Thus, when using the drill bit 45 (see FIG. 5), the drill bit sub 10 (see FIG. 2) extends for about ½" longer than in the modification of FIGS. 1–4.

While it is preferred that each of the break out rings 32 (see FIG. 2) and 40 be used, it should be understood that either or both may be omitted. If the break out ring 40 is omitted, then the upper portion 20 (see FIG. 1) of the drill bit sub 10 would be the same diameter as the intermediate portion 19. If the break out ring 32 (see FIG. 2) is omitted, the length of the protective sleeve 25 would be extended so that the bottom surface 33 of the protective sleeve 25 engages the surface 34 of the drill bit 28.

While it is preferred that the collar 21 be used so that the bottom surface 24 engages the upper surface 26 of the protective sleeve 25, it should be understood that the collar 24 could be omitted and the drill bit sub 10 formed with an angular annular surface for engagement with the upper surface 26 of the protective sleeve 25. In this arrangement, the intermediate portion 19 (see FIG. 1) of the drill bit sub 10 would extend for an additional 4", the length of the collar 21 (see FIG. 2).

Figure 6:
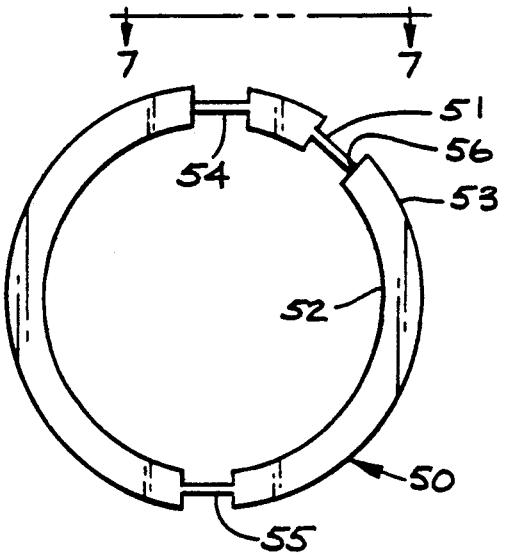
FIG. 6 is a top plan view of another embodiment of a bottom break out ring used with the drill bit sub of FIG. 1.

A break out ring 50 (see FIG. 6) may be employed instead of the break out ring 32 (see FIG. 3). The break out ring 50 (see FIG. 6), which extends for 0.7", has a first weakened portion 51 formed by removing 0.3" from its inner surface 52 and 0.3" from its outer surface 53. The first weakened portion 51 extends for an arcuate distance of 0.5".

The break out ring 50 has a second weakened portion 54 and a third weakened portion 55, which are diametrically disposed, formed therein. Each of the weakened portions 54 and 55 is formed by removing 0.3" from the inner surface 52 of the break out ring 50 for an arcuate distance of 0.5" and 0.3" from the outer surface 53 of the break out ring 50 for an arcuate distance of 0.5". Since the break out ring 50 has a thickness of 0.7" between the inner surface 52 and the outer surface 53, each of the weakened portions 51, 54, and 55 has a thickness of 0.1".

Figure 7:
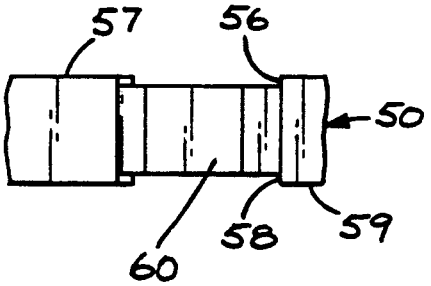
FIG. 7 is an enlarged fragmentary side elevational view of the bottom break out ring of FIG. 6 and taken along line 7—7 of FIG. 6.

As shown in FIG. 7, the break out ring 50 has a slot 56 formed in its upper surface 57 and a slot 58 formed in its lower surface 59. Each of the arcuate slots 56 and 58 extends for an arcuate distance of 2.125" between the remote ends of the weakened portions 51 (see FIG. 6) and 54. Each of the slots 56 (see FIG. 7) and 58 extends for a distance of 0.05" from the upper surface 57 and the lower surface 59, respectively, of the break out ring 50 to leave a portion 60 with a thickness of 0.6".

The break out ring 40 (see FIG. 2) could be replaced by a break out ring, which is the same as the break out ring 50 (see FIG. 6) except that it would have a length of 1" in the same manner as the break out ring 40 (see FIG. 2) has a length of 1".

An advantage of this invention is that it avoids the need for driving means to rotate a protective sleeve with a drill bit sub and a drill bit. Another advantage of this invention is that it avoids the need for a drill bit sub to have any break out lugs for a wrench. A further advantage of this invention is that a break out ring enables easier removal of portions of a drilling tool.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. A drilling tool for drilling a hole in the ground including:

a drill bit sub having a lower reduced portion;

removably mounted means removably mounted on said lower reduced portion of said drill bit sub;

said removably mounted means having a plurality of wear strips thereon;

said drill bit sub including an annular surface formed at an angle to its longitudinal axis;

said removably mounted means having an upper annular surface formed at the same angle to its longitudinal axis as said annular surface of said drill bit sub for engagement with said annular surface of said drill bit sub when said removably mounted means is mounted on said lower reduced portion of said drill bit sub;

a drill bit releasably attached to the bottom of said drill bit sub for rotation therewith;

said drill bit having a plurality of cutters;

said upper annular surface of said removably mounted means being held against said annular surface of said drill bit sub when said drill bit is releasably attached to said drill bit sub to prevent said removably mounted means from rotating relative to said drill bit sub when said drill bit sub is rotated;

and each of said wear strips on said removably mounted means being substantially aligned with one of said cutters on said drill bit.

2. The drilling tool according to claim 1 in which said removably mounted means includes:

a hollow cylindrical tube having said upper annular surface of said removably mounted means as its upper surface;

and a first ring disposed between said hollow cylindrical tube and said drill bit and engaging each, said first ring having at least one weakened portion capable of being fractured.

3. The drilling tool according to claim 1 including:

said drill bit sub including: an upper threaded end for attachment to a drill section of said drilling tool; and an upper reduced portion beneath said upper threaded end of said drill bit sub;

and a second ring mounted on said upper reduced portion of said drill bit sub, said second ring having at least one weakened portion capable of being fractured.

4. The drilling tool according to claim 2 in which:

said drill bit includes a support surface for supporting the bottom of said first ring;

and said hollow cylindrical tube has a bottom surface engaging the top of said first ring.

5. The drilling tool according to claim 2 in which each of said annular surface of said drill bit sub and said annular surface of said hollow cylindrical tube is at an angle of no greater than 87° to the longitudinal axis of each of said drill bit sub and said hollow cylindrical tube.

6. The drilling tool according to claim 1 including:

said drill bit sub including:

an upper threaded end for attachment to a drill section of said drilling tool;

and an upper reduced portion beneath said upper threaded end of said drill bit sub;

and a ring mounted on said upper reduced portion of said drill bit sub, said ring having at least one weakened portion capable of being fractured.

7. The drilling tool according to claim 6 in which each of said annular surface of said drill bit sub and said upper annular surface of said removably mounted means is at an angle no greater than 87° to the longitudinal axis of each of said drill bit sub and said removably mounted means.

8. The drilling tool according to claim 1 in which each of said annular surface of said drill bit sub and said upper annular surface of said removably mounted means is at an angle of no greater than 87° to the longitudinal axis of each of said drill bit sub and said removably mounted means.

9. The drilling tool according to claim 6 in which said ring includes:

inner and outer circular surfaces;

first, second, and third weakened portions capable of being fractured;

said second weakened portion being circumferentially spaced from said first weakened portion less than said second weakened portion is circumferentially spaced from said third weakened portion, said second weakened portion being circumferentially spaced less than 180° from said first weakened portion;

and said third weakened portion being circumferentially spaced from said first weakened portion less than said third weakened portion is circumferentially spaced from said second weakened portion.

10. The drilling tool according to claim 9 in which said ring includes:

upper and lower surfaces substantially parallel to each other;

a first slot formed in said upper surface between at least a portion of said first weakened portion and at least a portion of said second weakened portion;

and a second slot formed in said lower surface between at least a portion of said first weakened portion and at least a portion of said second weakened portion.

11. A drilling tool for drilling a hole in the ground including:

a drill bit sub having a lower reduced portion;

a collar mounted on the uppermost portion of said lower reduced portion and fixed to said drill bit sub;

said collar having its lower surface formed at an angle to its longitudinal axis;

removably mounted means removably mounted on said lower reduced portion of said drill bit sub beneath said collar;

said removably mounted means having a plurality of wear strips thereon;

said removably mounted means having its upper surface formed at the same angle to its longitudinal axis as said lower surface of said collar for engagement with said lower surface of said collar;

a drill bit releasably attached to the bottom of said drill bit sub for rotation therewith;

said drill bit having a plurality of cutters;

said upper surface of said removably mounted means being held against said lower surface of said collar when said drill bit is releasably attached to said drill bit sub to prevent said removably mounted means from rotating relative to said drill bit sub when said drill bit sub is rotated;

and each of said wear strips on said removably mounted means being substantially aligned with one of said cutters on said drill bit.

12. The drilling tool according to claim 11 in which said removably mounted means includes:

a hollow cylindrical tube having said upper annular surface of said removably mounted means as its upper surface;

and a first ring disposed between said hollow cylindrical tube and said drill bit and engaging each, said first ring has at least one weakened portion capable of being fractured.

13. The drilling tool according to claim 12 including:

said drill bit sub including:

an upper threaded end for attachment to a drill section of said drilling tool;

and an upper reduced portion beneath said upper threaded end of said drill bit sub;

and a second ring mounted on said upper reduced portion of said drill bit sub, said second ring having at least one weakened portion capable of being fractured.

14. The drilling tool according to claim 12 in which:

said drill bit includes a support surface for supporting the bottom of said first ring;

and said hollow cylindrical tube has a bottom surface engaging the top of said first ring.

15. The drilling tool according to claim 12 in which each of said lower surface of said collar and said upper surface of said hollow cylindrical tube is at an angle of no greater than 87° to the longitudinal axis of each of said collar and said hollow cylindrical tube.

16. The drilling tool according to claim 11 including:

said drill bit sub including:

an upper threaded end for attachment to a drill section of said drilling tool;

and an upper reduced portion beneath said upper threaded end of said drill bit sub;

and a ring mounted on said upper reduced portion of said drill bit sub, said ring having at least one weakened portion capable of being fractured.

17. The drilling tool according to claim 16 in which each of said lower surface of said collar and said upper surface of said removably mounted means is at an angle of no greater than 87° to the longitudinal axis of each of said collar and said removably mounted means.

18. The drilling tool according to claim 11 in which each of said lower surface of said collar and said upper surface of said removably mounted means is at an angle of no greater than 87° to the longitudinal axis of each of said collar and said removably mounted means.

19. The drilling tool according to claim 11 in which each of said lower surface of said collar and said upper surface of said removably mounted means is at an angle of 85° to the longitudinal axis of each of said collar and said removably mounted means.

20. A protective sleeve for removably mounting on a lower reduced portion of a drill bit sub of a drilling tool having a drill bit with cutters for drilling a hole in the ground with the drill bit releasably attached to the drill bit sub, said protective sleeve including:

a hollow cylindrical tube having its upper surface formed at an angle to its longitudinal axis for engagement with a corresponding annular surface on the drill bit sub formed at the same angle to its longitudinal axis as said upper surface of said hollow cylindrical tube;

and said hollow cylindrical tube having a plurality of equally angularly spaced wear strips on its outer surface for substantial alignment with the cutters on the drill bit when said hollow cylindrical tube is mounted on the lower reduced portion of the drill bit sub and the drill bit is releasably attached to the drill bit sub to cause the upper surface of the hollow cylindrical tube to be held against the corresponding annular surface of the drill bit sub.

21. The protective sleeve according to claim 20 in which said upper surface of said hollow cylindrical tube is at an angle of no greater than 87° to its longitudinal axis.

22. The protective sleeve according to claim 20 in which said upper surface of said hollow cylindrical tube is at an angle of 85° to its longitudinal axis.

23. A break out ring for mounting on a circular surface of a drilling tool including:

inner and outer circular surfaces;

first, second, and third weakened portions capable of being fractured;

said second weakened portion being circumferentially spaced from said first weakened portion less than said second weakened portion is circumferentially spaced from said third weakened portion, said second weakened portion being circumferentially spaced less than 180° from said first weakened portion;

and said third weakened portion being circumferentially spaced from said first weakened portion less than said third weakened portion is circumferentially spaced from said second weakened portion.

24. The ring according to claim 23 including:

upper and lower surfaces substantially parallel to each other;

a first slot formed in said upper surface between at least a portion of said first weakened portion and at least a portion of said second weakened portion;

and a second slot formed in said lower surface between at least a portion of said first weakened portion and at least a portion of said second weakened portion.

25. The ring according to claim 24 including each of said first weakened portion, said second weakened portion, and said third weakened portion being formed by removing material from at least one of said inner and outer circular surfaces.

26. The ring according to claim 23 including:

upper and lower surfaces substantially parallel to each other;

a first slot formed in said upper surface from the remote end of said first weakened portion to the remote end of said second weakened portion;

and a second slot formed in said lower surface from the remote end of said first weakened portion to the remote end of said second weakened portion.

27. The ring according to claim 26 including each of said first weakened portion, said second weakened portion, and said third weakened portion being formed by removing material from at least one of said inner and outer circular surfaces.

28. The ring according to claim 26 including each of said first weakened portion, said second weakened portion, and said third weakened portion being formed by removing material from each of said inner and outer circular surfaces.

29. The ring according to claim 23 including each of said first weakened portion, said second weakened portion, and said third weakened portion being formed by removing material from at least one of said inner and outer circular surfaces.

* * * * *

UNITED STATES PATENT AND TRADEMARK OFFICE

CERTIFICATE OF CORRECTION

PATENT NO. : 5,234,063

DATED : August 10, 1993

INVENTOR(S) : Stephen M. Collinsworth

It is certified that error appears in the above-identified patent and that said Letters Patent is hereby corrected as shown below:

Column 5, line 59, " 1' " should read --- 1" --- .

Column 8, lines 41-44, should read as follows:

--- said drill bit sub including:

an upper threaded end for attachment to a drill section of said drilling tool;

and an upper reduced portion beneath said upper threaded end of said drill bit sub; --- .

Signed and Sealed this

Twelfth Day of April, 1994

Bruce Lehman

BRUCE LEHMAN

*Commissioner of Patents and Trademarks*

*Attest:*

*Attesting Officer*